United States Patent [19]

Kanno

[11] Patent Number: 4,594,978

[45] Date of Patent: Jun. 17, 1986

[54] OVER-REVOLUTION PREVENTING APPARATUS FOR INTERNAL COMBUSTION ENGINES

[75] Inventor: Isao Kanno, Shizuoka, Japan

[73] Assignee: Sanshin Kogyo Kabushiki Kaisha, Japan

[21] Appl. No.: 646,565

[22] Filed: Aug. 31, 1984

[30] Foreign Application Priority Data

Sep. 1, 1983 [JP] Japan ..... 58-159056

[51] Int. Cl.[4] ..... F02P 9/00

[52] U.S. Cl. ..... 123/335; 123/198 DC

[58] Field of Search ..... 123/335, 352, 198 DC

[56] References Cited

U.S. PATENT DOCUMENTS

| | | | |
|---|---|---|---|
| 3,182,648 | 5/1965 | Schneider | 123/335 |
| 3,402,327 | 9/1968 | Blackburn | 123/335 |
| 4,237,997 | 12/1980 | Swanson | 123/335 |
| 4,336,778 | 6/1982 | Howard | 123/335 |
| 4,404,940 | 9/1983 | Sieja | 123/335 |
| 4,459,951 | 7/1984 | Tobinaga | 123/335 |

*Primary Examiner*—Ronald B. Cox

*Attorney, Agent, or Firm*—Harness, Dickey & Pierce

[57] ABSTRACT

An electronic revolution rate limiting apparatus is described which generally comprises a transducer for generating a tachometer signal which is indicative of the revolution rate of the internal combustion engine, a circuit for generating a rate signal which is derived from an oscillator and is responsive to the operation state of the engine to determine the maximum revolution rate for each of a plurality of operation states, a circuit for producing a control signal which is responsive to the tachometer signal and the rate signal, and a switch for interacting with the ignition system of the engine to prevent a sparking voltage from being induced in the ignition system in response to the value of the control signal.

14 Claims, 2 Drawing Figures

OVER-REVOLUTION PREVENTING APPARATUS FOR INTERNAL COMBUSTION ENGINES

BACKGROUND OF THE INVENTION

The present invention relates generally to internal combustion engines, and particularly to an apparatus for electronically limiting the revolution rate of internal combustion engines.

Internal combustion engines are designed to operate over certain speed ranges, which are generally expressed in revolutions per minute (RPM). To insure that these engines are not operated above the maximum rated speed, various techniques have been employed for mechanically limiting the speed of the engine. In one such technique, a mechanical linkage is employed to limit or block the travel of the throttle linkage beyond a certain point. Although mechanical linkages are effective for this purpose, it will be appreciated that these mechanical linkages can become relatively complex when more than one maximum speed is desirable. For example, in a motor or power plant which is designed to operate in different operation states, such as drive states (e.g., forward, neutral or reverse), it is generally advantageous to permit a different maximum speed for each drive speed. Thus, it will be appreciated that it is typically desirable to have a lower maximum speed for the engine when the power plant is in neutral (or other no load condition) than when the power plant is in forward, and so forth.

It is, therefore, a principal object of this invention to provide an improved apparatus and method for limiting the speed of an internal combustion engine which does not depend upon mechanical linkages and is also capable of permitting a plurality of maximum speeds for the engine.

It is another object of the present invention to provide an improved apparatus and method for electronically limiting the revolution rate of an internal combustion engine through an interaction with the ignition system for the engine.

It is a further object of the present invention to provide an improved electronic revolution rate limiting apparatus and method for limiting the engine speed when the power plant is shifted from one drive state to another.

It is an additional object of the present invention to provide an improved electronic revolution rate limiting apparatus which will remain accurate and not be adversely affected by engine temperature and/or power supply voltage variations.

It is yet another object of the present invention to provide an improved electronic revolution rate limiting apparatus which will permit the operator to set the maximum revolution rates.

SUMMARY OF THE INVENTION

To achieve the foregoing objects, the present invention provides an electronic revolution rate limiting apparatus which generally comprises means for generating a tachometer signal which is indicative of the revolution rate of the internal combustion engine, means for generating a rate signal which is derived from an oscillator and is responsive to the operation state of the engine to determine the maximum revolution rate for each of a plurality of operation states, means for producing a control signal which is responsive to a comparison between the tachometer signal and the rate signal, and means for interacting with the ignition system of the engine to prevent a sparking voltage from being induced in the ignition system in response to the value of the control signal. When the revolution rate limiting apparatus is employed in a power plant in which the operation states comprise a plurality of drive states (e.g., forward, neutral, reverse), the means for generating the rate signal is responsive to which drive state the power plant is in, such that the maximum revolution rate may be individually controlled for each drive state.

In accordance with one feature of the present invention, the revolution rate limiting apparatus interacts with a capacitive discharge ignition system. In this embodiment, the interacting means generally comprises a switch which is connected to the trigger circuit of the ignition system such that the discharging of a capacitor is prevented by the switch in response to the value of the control signal.

In accordance with another feature of the present invention, the interacting means comprises a switch which is connected across the primary winding of the ignition coil of the ignition system to selectively provide a short circuit across the primary winding in response to the value of the control signal.

Additional advantages and features of the present invention will become apparent from a reading of the detailed description of the preferred embodiments which make reference to the following set of drawings, in which:

DETAILED DESCRIPTION OF THE PREFERRED EMBODIMENT

Figure 1:
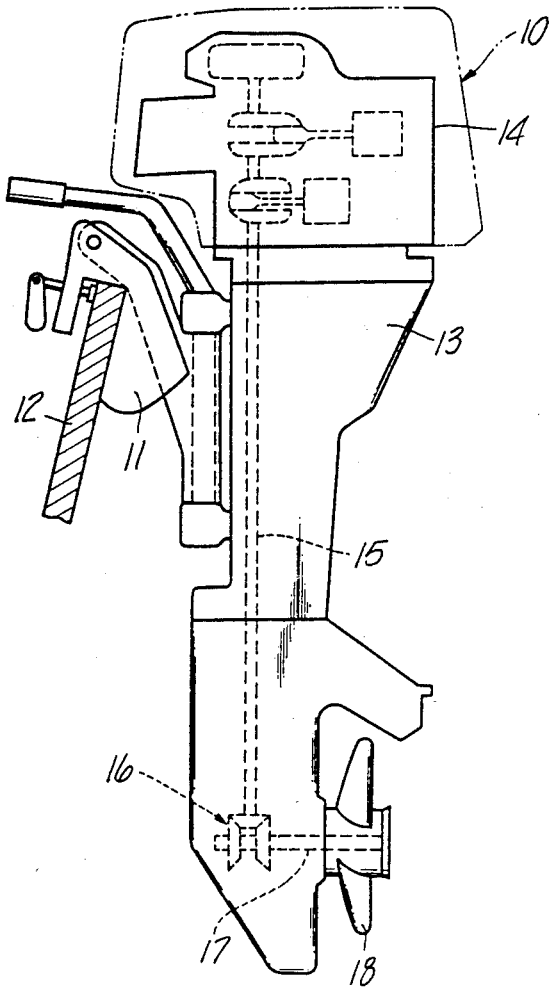
FIG. 1 is a diagrammatic view of an outboard motor having a revolution rate limiting apparatus constructed in accordance with an embodiment of the present invention and operating in accordance with a method of the present invention.

Referring to FIG. 1, an outboard motor having a revolution rate limiting circuit in accordance with this invention is identified generally by the reference numeral 10. The outboard motor 10 includes a clamping bracket 11 for mounting the motor to the stern or transom 12 of a boat. The heart of the outboard motor 10 is an internal combustion engine 14, which is depicted as having two cylinders and an output shaft 15. The output shaft 15 extends through a drive shaft housing 13, and is coupled to a propeller shaft 17 through transmission gears 16. A propeller 18 is fixedly secured to the propeller shaft 17 such that the propeller will rotate with the propeller shaft.

The transmission gears 16 operate with a manually actuated shifting linkage (not shown) to change the drive state of the outboard motor 10. Thus, the transmission gears 16 are operable to convert the rotation of the engine output shaft 15 into a "forward" or "reverse" rotation of the propeller shaft 17. Additionally, the transmission gears 16 are operable to decouple the propeller shaft 17 from the output shaft 15 to provide a "neutral" drive state in which no load is placed upon the engine 14.

While the present invention is described in connection with the outboard motor 10, it will become readily apparent to those skilled in the art that the invention may be susceptible for use with other types of engines and power plants. It should also be understood that the present invention may also be susceptible with additional or different operation or drive states than those provided by the outboard motor 10.

Figure 2:
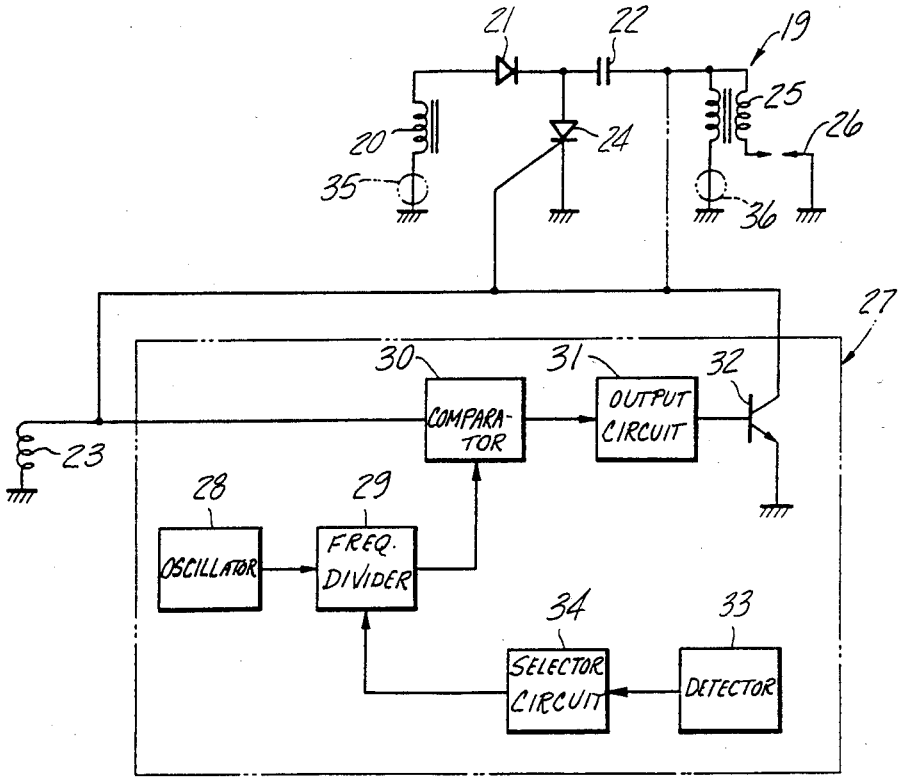
FIG. 2 is a circuit diagram of an ignition system and revolution rate limiting apparatus employable in the outboard motor illustrated in FIG. 1.

Referring to FIG. 2, a circuit diagram of an ignition system circuit and a revolution rate limiting circuit is shown which is employable in the outboard motor 10 of FIG. 1. The ignition system includes an ignition coil 19 and a trigger circuit which comprises a generating coil 20, a diode 21, a capacitor 22 and a silicon controlled rectifier (SCR) 24. As will be appreciated by those skilled in the art, the ignition system is a magneto-type capacitive discharge ignition system, which uses the rotation of permanent magnets on the flywheel of the engine 14 to induce a voltage in the generating coil 20. During positive excursions of the alternating voltage induced in the generating coil 20, the capacitor 22 is charged. The diode 21 is connected between the generating coil 20 and the capacitor 22 to prevent the capacitor from discharging during negative excursions of the voltage induced in the generating coil.

In order to generate a voltage in the secondary winding 25 of the ignition coil 19 which will cause the spark plug 26 to produce a spark across its electrodes, the SCR 24 must be gated on at the appropriate time. This will permit the capacitor 22 to discharge through the loop which includes the primary winding of the ignition coil 19, and cause the firing of the spark plug 26 in a known manner.

The gating of the SCR 24 is controlled in part by a pulser coil 23. The pulser coil 23 is designed to generate a pulse with each revolution of the flywheel of the engine by virtue of an additional permanent magnet located on the engine flywheel. These pulses are transmitted to the gate of the SCR 24 via diode 28 and resistor 29.

Since the frequency at which the pulses are generated by the pulser coil 23 is directly related to the rate at which the output shaft 15 of the engine rotates, the pulses generated by the pulser coil also provides a tachometer signal which is indicative of the revolution rate or speed of the engine 14. Thus, the pulser coil not only provides a trigger signal for the ignition system, but also provides a speed transducer for the revolution rate limiting apparatus in accordance with the present invention.

The revolution rate limiting apparatus of FIG. 2 features a control circuit which is generally designated by the reference numeral 27. The control circuit includes an oscillator 28, a frequency divider 29, a comparator 30, an output circuit 31, a transistor 32, a shift position or drive state detector 33, and a selector circuit 34. The oscillator 28 is preferably a crystal oscillator which produces a reference pulse signal having a fixed or constant frequency. The frequency divider 29 is used to divide the frequency of the reference pulse signal generated by the oscillator 28.

The amount or rate at which the frequency of the reference pulse signal is divided is determined by the drive state detector 33 and the selector circuit 34. Thus, when the output signal from the detector 33 indicates that the engine 14 is in the forward drive state, then the selector circuit 34 will produce a command signal which will cause the frequency divider 29 to divide the frequency of the reference pulse signal down to a predetermined frequency. This predetermined frequency sets or determines the maximum revolution rate for the forward drive state of the engine 14. Similarly, when the detector 33 indicates that the engine 14 is in one of the other drive states (e.g., neutral, reverse), then the selector circuit 34 will cause the frequency divider 29 to divide the frequency of the reference pulse signal down to the particular predetermined frequency for the current drive state of the engine 14.

Thus, for example, if a maximum revolution rate of 6000 RPMs was desired for the forward drive state, the frequency of the reference pulse signal would be divided down by one amount. Then, if a maximum revolution rate of 4000 RPMs was desired for the reverse drive state, then the frequency of the reference pulse signal would be divided down by an amount greater than that for the forward drive state. Likewise, if a maximum revolution rate of 3500 RPMs was desired for the neutral drive state, then the frequency of the reference pulse signal would be divided down by a still greater amount. Accordingly, the selector circuit 34 operates to switch between different division rates for the frequency divider circuit 29 depending upon the output of the detector 33. It should also be noted that the selector circuit may be provided with means for permitting the operator to select the maximum revolution rates within certain limits, such as a manually adjustable potentiometer.

The comparator 30 compares the frequency of the trigger pulses produced by the pulser coil 23 with the frequency of the rate signal produced by the frequency divider 29. When the frequency of the trigger pulses exceeds the frequency of the rate signal, the comparator produces a control signal indicative of an over-revolution condition for the particular drive state of the engine 14. In other words, when the pulse interval of the trigger pulses becomes shorter than that of the rate signal, the control signal output from the comparator 30 will indicate the existence of an over-revolution condition. Thus, an over-revolution condition occurs whenever the actual revolution rate of the engine 14 exceeds the predetermined maximum revolution rate for the current drive state for the engine 14.

The control signal output from the comparator 30 is transmitted through the output circuit 31, which may be an amplifier or a driver, to bias the transistor 32 into a conducting state. While a transistor is employed in this particular embodiment, it should be appreciated that other suitable controlled conduction devices may be employed in the appropriate application. When the transistor 32 is turned on, it will cause the engine 14 to misfire through an interaction with the ignition circuit. In other words, the transistor 32 operates to prevent a sparking voltage from being induced in the secondary winding 25 of the ignition coil 19.

When the transistor 32 is in an on condition, the trigger pulses generated by the pulser coil 23 will be transmitted through the transistor, thereby preventing or interrupting the gating signal to the SCR 24 which is necessary in order to permit the capacitor 22 to discharge and fire the spark plug 26. This interruption will continue until the revolution rate has decreased below the appropriate maximum revolution rate. It should also be noted at this point that if the outboard motor 10 is shifted from the forward drive state to the neutral drive state at a revolution rate which exceeds the neutral maximum revolution rate, then the revolution rate limiting apparatus will respond by interrupting the firing of the spark plug 26 until the revolution rate drops below the maximum revolution rate for the neutral drive state.

In one variation of the revolution rate limiting apparatus according to the present invention, the transistor 32 is connected across the primary winding of the ignition coil 19 (as shown by the phantom line in FIG. 2). In this configuration, the capacitor 22 is permitted to discharge during an over-revolution condition, however, the transistor 32 will create a short circuit across the primary winding which will prevent a sparking voltage from being induced in the secondary winding 25 of the ignition coil 19. In accordance with additional variations of the revolution rate limiting apparatus, a controlled conduction device or other electronic switch could be connected in the ignition system at either of the phantom circles 35 and 36. In this configuration, the switch 35 or the switch 36 will shut off the flow of electrical current in the appropriate branches of the ignition system circuit when the engine 14 operates over its predetermined maximum revolution rate.

It will be appreciated that the above disclosed embodiment is well calculated to achieve the aforementioned objectives of the present invention. In addition, it is evident that those skilled in the art, once given the benefit of the foregoing disclosure, may now make modifications of the specific embodiment described herein without departing from the spirit of the present invention. Such modifications are to be considered within the scope of the present invention which is limited solely by the scope and spirit of the appended claims.

I claim:

1. In an internal combustion engine which is capable of operating in a plurality of selectable operation states and has an ignition system, a revolution rate limiting apparatus, comprising:

means for generating a tachometer signal indicative of the revolution rate of said internal combustion engine;

means for generating a rate signal which is derived from an oscillator such that the frequency of the rate signal is responsive to the operation state of said internal combustion engine to determine the maximum revolution rate for each of said operation states; -- means for producing a control signal which is responsive to a comparison between the frequency of said tachometer signal and the frequency of said rate signal; and means for interacting with said ignition system to prevent a sparking voltage from being induced in said ignition system in response to the value of said control signal until the revolution rate of said internal combustion engine decreases below the maximum revolution rate for the operation state that said internal combustion engine is in.

2. The invention according to claim 1, wherein said ignition system is a capacitive discharge ignition system, and said interacting means prevents a capacitor in said ignition system from being discharged through the primary winding of an ignition coil in said ignition system.

3. The invention according to claim 1, wherein said means for generating said tachometer signal includes a pulse generating coil.

4. The invention according to claim 1, wherein said oscillator has a fixed frequency.

5. The invention according to claim 1, wherein said interacting means includes a controlled conduction device connected electrically in parallel with the primary winding of said ignition coil, which is gated on by said control signal to provide an electrical current path of low resistence across the primary winding of said ignition coil when the maximum revolution rate is attained.

6. In a power plant having an internal combustion engine, a shaft for transmitting the mechanical power produced by said internal combustion engine, and a transmission for selectively shifting said shaft into one of a plurality of drive states, a revolution rate limiting apparatus, comprising:

means for generating a tachometer signal indicative of the revolution rate of said internal combustion engine;

means for detecting the drive state of said internal combustion engine;

oscillator means for generating a reference pulse signal having a fixed frequency;

means for producing a rate signal which determines a maximum revolution rate for each of said plurality of drive states in response to said pulse signal and said detecting means, said determining means including means for dividing the frequency of said reference pulse signal, and means for selecting the amount by which said dividing means divides the frequency of said reference pulse signal in response to said detecting means;

means for producing a control signal in response to the comparison of said tachometer signal and said rate signal;

switching means, associated with an ignition system of said internal combustion engine, for preventing a sparking voltage from being induced in the secondary winding of an ignition coil in said ignition system, in response to said control signal.

7. The invention according to claim 6, wherein said means for generating said tachometer signal includes a pulse generating coil.

8. The invention according to claim 7, wherein said ignition system is a capacitive discharge ignition system.

9. The invention according to claim 8, wherein said capacitive discharge ignition system includes a controlled conduction device for selectively permitting the discharging of a capacitor through the primary winding of said ignition coil, and said switching means is connected to said controlled conduction device such that said switching means controls the gating of said controlled conduction device.

10. The invention according to claim 8, wherein said switching means includes a controlled conduction device connected electrically in parallel with the primary winding of said ignition coil, which is gated on by said control signal to provide an electrical current path of low resistance across the primary winding of said ignition coil when the maximum revolution rate for the drive state of said shaft is attained.

11. The invention according to claim 6, wherein said means for producing a control signal includes a comparator for comparing the frequencies of said tachometer and rate signals.

12. The invention according to claim 6, wherein said plurality of drive states includes forward, neutral and reverse.

13. The invention according to claim 12, wherein said power plant is a marine outboard motor.

14. A method for electronically limiting the revolution rate of an internal combustion engine in a power plant having a shaft for transmitting the mechanical power produced by said internal combustion engine and a transmission for selectively shifting said shaft into one of a plurality of drive states, comprising the steps of:

measuring the revolution rate of said internal combustion engine;

generating a rate signal whose frequency is responsive to the particular drive state of said internal combustion engine;

determining if the revolution rate measured exceeds a predetermined maximum revolution rate for the particular drive state of said internal combustion engine by comparing the frequency of said rate signal and the revolution rate frequency of said internal combustion engine; and producing a control signal in response thereto which will interact with an ignition system of said internal combustion engine to prevent the firing of a spark plug in said internal combustion engine.

* * * * *